US007105218B1

(12) United States Patent
Klemm et al.

(10) Patent No.: US 7,105,218 B1
(45) **Date of Patent: *Sep. 12, 2006**

(54) COVER PLATE FOR HOUSEHOLD DEVICES

(75) Inventors: Klaus Klemm, Oberelsbach (DE); Klaus Müller, Sulzbach (DE)

(73) Assignee: Basell Polyolefine GmbH, Frankfurt (DE)

( * ) Notice: Subject to any disclaimer, the term of this patent is extended or adjusted under 35 U.S.C. 154(b) by 146 days.

This patent is subject to a terminal disclaimer.

(21) Appl. No.: 09/640,092

(22) Filed: Aug. 17, 2000

(30) Foreign Application Priority Data

Aug. 25, 1999 (DE) ..... 199 40 145

(51) Int. Cl.
*B32B 1/04* (2006.01)

(52) U.S. Cl. ..... 428/68; 428/119; 428/192; 428/542.2; 312/228; 52/782.2; 52/800.11

(58) Field of Classification Search ..... 428/68, 428/542.2, 76, 102, 119, 192, 194; 52/782.2, 52/782.24, 800.11; 312/137, 140.1, 228; D32/8, 3

See application file for complete search history.

(56) References Cited

U.S. PATENT DOCUMENTS 3,156,041 A * 11/1964 Gault ..... 228/181
3,533,153 A * 10/1970 Melill et al. ..... 228/118
5,830,552 A * 11/1998 Meier et al. ..... 428/68

FOREIGN PATENT DOCUMENTS

| | | |
|---|---|---|
| DE | 196 04 370 | 6/1987 |
| DE | 195 14 821 | 11/1995 |
| DE | 295 05 295 | 9/1996 |
| DE | 298 12 911 | 12/1998 |
| EP | 0 234 192 | 9/1987 |
| EP | 0 238 115 | 9/1987 |
| EP | 0 604 260 | 6/1994 |
| EP | 0 731 203 | 9/1996 |
| FR | 2 673 575 | 9/1992 |

* cited by examiner

*Primary Examiner*—Gladys JP Corcoran
*Assistant Examiner*—Abraham Bahta
(74) *Attorney, Agent, or Firm*—Novak Druce & Quigg, LLP

(57) ABSTRACT

A cover plate for household devices comprises a decorative part and a reinforcer with integrated molded functional elements, where the reinforcer has the structure of a sheet or box or crate and has a closed lower side. The decorative part used is preferably composed of a support, of a decorative layer applied to this support, and of a heat-cured layer situated on the decorative layer, where the support material used comprises a thermoplastic. The reinforcer may also have ribs.

12 Claims, 2 Drawing Sheets

COVER PLATE FOR HOUSEHOLD DEVICES

FIELD OF THE INVENTION

The present invention relates to a cover plate for household devices, comprising a decorative part and a reinforcer with integrated, molded-on functional elements, where the reinforcer has the structure of a sheet or box or crate and has a closed lower side. The present invention further relates to a process for producing the novel cover plate, and also to its use as constituent of a household device, for example of a washing machine, of a household dryer or of a dishwasher.

BACKGROUND OF THE INVENTION

Worktops known hitherto in the household sector are essentially composed of dual-side-laminated particle boards, and these have to be made moisture-resistant by provision of an edging made from a thermoplastic, since the particle board tends to swell if moisture penetrates in from the edges. To prevent this a thermoplastic has to be adhesive-bonded to the particle boards to make them moisture-resistant. These worktops made from laminated particle boards are moreover not recyclable and the industrial processes for their production are very complicated.

There are also worktops disclosed in DE-A 19604370 and made from thermoplastics, and comprising a plastic sheet to the lower side of which has been attached a support which is composed of a grating-like module with an open lower side. Although these worktops are moisture-resistant and recyclable, they are relatively complicated to produce and for some application sectors require a more stable construction.

BRIEF SUMMARY OF THE INVENTION

It is an object of the present invention, therefore, to overcome the disadvantages described and to develop an improved cover plate which can be used for household devices and has high strength and stability and is also moisture-resistant, easy to produce and moreover recyclable.

We have found that this object is achieved by developing an improved cover plate for household devices, comprising a decorative part and a reinforcer with integrated, molded-on functional elements, where the reinforcer has the structure of a sheet or box or crate and has a closed lower side. The reinforcer may also have ribs.

DETAILED DESCRIPTION OF THE INVENTION

The decorative part present in the novel cover plate is preferably composed of a support, of a decorative layer applied thereto, and of a heat-cured layer situated on the decorative layer. It can also be advisable to insert an intermediate layer between the support and the decorative layer. It is also possible, if desired, for there to be the corresponding intermediate layers, decorative layers and heat-cured layers applied on both sides of the support, giving a sandwich-type structure with the support in the middle.

Based on the total weight of the support, the material of the support may comprise from 1 to 60% by weight, preferably from 5 to 50% by weight, particularly preferably from 10 to 40% by weight, of reinforcing fillers, such as barium sulfate, magnesium hydroxide, talc with an average particle size of from 0.1 to 10 μm, measured to DIN 66 115, wood, flax, chalk, glass fibers, coated glass fibers, long or short glass fibers, glass beads or mixtures of these. The material of the support may also comprise the usual additives, such as light stabilizers, UV stabilizers, heat stabilizers, pigments, carbon blacks, lubricants, flame retardants, blowing agents and the like, in the amounts which are usual and required. The support is in particular composed of thermoplastics.

Examples of thermoplastics which form the support for the decorative part are polypropylene, polyethylene, polyvinyl chloride, polysulfones, polyether ketones, polyesters, polycycloolefins, polyacrylates and polymethacrylates, polyamides, polycarbonate, polyurethanes, polyacetals, e.g. polyoxymethylene, polybutylene terephthalates and polystyrenes. Both homopolymers and copolymers of these thermoplastics may be used here. Besides the reinforcing fillers, the supporting layer is preferably composed of polypropylene, polyoxymethylene, polybutylene terephthalate or polystyrene, in particular of copolymers of styrene with subordinate proportions of one or more comonomers, e.g. butadiene, α-methylstyrene, acrylonitrile, vinylcarbazole, or esters of acrylic, methacrylic or itaconic acid. The support of the novel layered composite material may also comprise recycled materials made from these thermoplastics.

For the purposes of the present invention, polyoxymethylenes are homo- or copolymers of aldehydes, for example of formaldehyde, and of cyclic acetals. These have repeating carbon-oxygen bonds in the molecule and have melt flow rates (MFR), to ISO 1133, of from 5 to 40 g/10 min, in particular from 5 to 30 g/10 min, at 230° C. under a load of 2.16 kg.

The polybutylene terephthalate preferably used is a relatively high-molecular-weight esterification product of terephthalic acid with butylene glycol and has a melt flow rate (MFR), to ISO 1133, of from 5 to 50 g/10 min, in particular from 5 to 30 g/10 min, at 230° C. under a load of 2.16 kg.

Copolymers of styrene are in particular copolymers having up to 45% by weight, preferably up to 20% by weight, of copolymerized acrylonitrile. These copolymers made from styrene and acrylonitrile (SAN) have a melt flow rate (MFR), to ISO 1133, of from 1 to 25 g/10 min, in particular from 4 to 20 g/10 min, at 230° C. under a load of 2.16 kg.

Preference is also given to the use of copolymers of styrene comprising up to 35% by weight, in particular up to 20% by weight, of copolymerized acrylonitrile and up to 35% by weight, in particular up to 30% by weight, of copolymerized butadiene. The melt flow rate of these copolymers made from styrene, acrylonitrile and butadiene (ABS), to ISO 1133, is from 1 to 40 g/10 min, in particular from 2 to 30 g/10 min, at 230° C. under a load of 2.16 kg.

Other particular materials used for the support of the decorative part are polyolefins, such as polyethylene or polypropylene, preferably the latter. For the purposes of the present invention, polypropylene is a homo- or copolymer of propylene. Copolymers of propylene contain subordinate amounts of monomers copolymerizable with propylene, for example $C_2$–$C_8$1-alkenes, such as ethylene, 1-butene, 1-pentene or 1-hexene. It is also possible to use two or more different comonomers.

Examples of particularly suitable support materials are homopolymers of propylene or copolymers of propylene with up to 50% by weight of other copolymerized 1-alkenes having up to 8 carbon atoms. The copolymers of propylene here are random copolymers or block or impact copolymers. If the copolymers of propylene have a random structure they generally contain up to 15% by weight, preferably up to 6% by weight, of other 1-alkenes having up to 8 carbon atoms, in particular ethylene, 1-butene or a mixture of ethylene and 1-butene.

Block or impact copolymers of propylene are polymers for which the first stage is to prepare a propylene homopolymer or a random copolymer of propylene with up to 15% by weight, preferably up to 6% by weight, of other 1-alkenes having up to 8 carbon atoms and then, in the second stage, polymerize onto this a propylene-ethylene copolymer having an ethylene content of 15 to 80% by weight, where the propylene-ethylene copolymer may also contain other $C_4$–$C_8$1-alkenes. The amount of the propylene-ethylene copolymer polymerized on here is generally such that in the final product the proportion of the copolymer produced in the second stage is from 3 to 60% by weight.

The polymerization to prepare polypropylene may use a Ziegler-Natta catalyst system. The catalyst systems used here are in particular those which have cocatalysts in the form of organic aluminum compounds b) and electron-donor compounds c), as well as a titanium-containing solid component a).

It is, however, also possible to use catalyst systems based on metallocene compounds and, respectively, based on metal complexes active in polymerization.

Specifically, usual Ziegler-Natta catalyst systems comprise a titanium-containing solid component, inter alia halides or alcoholates of tri- or tetravalent titanium, and also a halogen-containing magnesium compound, inorganic oxides, e.g. silica gel, as supports, and also electron-donor compounds. These are in particular carboxylic acid derivatives, or else ketones, ethers, alcohols or organosilicon compounds.

The titanium-containing solid component may be prepared by methods known per se. Examples of these are given, inter alia, in EP-A 45 975, EP-A 45 977, EP-A 86 473, EP-A 171 200, GB-A 2 111 066, U.S. Pat. No. 4,857,613 and U.S. Pat. No. 5,288,824. The process known from DE-A 195 29 240 is preferably used.

Suitable aluminum compounds b), besides trialkylaluminum compounds, are those compounds in which one alkyl group has been replaced by an alkoxy group or by a halogen atom, for example by chlorine or bromine. The alkyl groups may be identical or differ from one another. The alkyl groups may be linear or branched. Preference is given to the use of trialkylaluminum compounds having alkyl groups each of which has from 1 to 8 carbon atoms, for example trimethylaluminum, triethylaluminum, triisobutylaluminum, trioctylaluminum or methyldiethylaluminum, or mixtures of these.

A further cocatalyst used, besides the aluminum compound b), is generally electron-donor compounds c), such as mono- or polybasic carboxylic acids, carboxylic anhydrides or carboxylic esters, or else ketones, ethers, alcohols or lactones, or else organophosphorus or organosilicon compounds. The electron-donor compounds c) may be identical with or different from the electron-donor compounds used to prepare the titanium-containing solid component a).

Instead of Ziegler-Natta catalyst systems it is also possible to prepare polypropylene by using metallocene compounds and, respectively, metal complexes active in polymerization.

For the purposes of the present invention, metallocenes are complex compounds made from metals of transition groups of the Periodic Table with organic ligands, giving effective catalyst systems when combined with metallocenium-ion-forming compounds. When used to prepare polypropylene, the metallocene complexes in the catalyst system are generally in supported form. Supports frequently used are inorganic oxides, but it is also possible to use organic supports in the form of polymers, such as polyolefins. Preference is given to the inorganic oxides described above, which are also used to prepare the titanium-containing solid component a).

The central atoms in the metallocenes usually used are titanium, zirconium or hafnium, preferably zirconium. The central atom generally has bonding via a $\pi$ bond to at least one, generally substituted, cyclopentadienyl group, and also to other substituents. The other substituents may be halogens, hydrogen or organic radicals, preferably fluorine, chlorine, bromine or iodine or a $C_1$–$C_{10}$-alkyl. The cyclopentadienyl group may also be a constituent of an appropriate heteroaromatic system.

Preferred metallocenes contain central atoms which have bonding via two identical or different $\pi$ bonds to two substituted cyclopentadienyl groups. Particularly preferred metallocenes are those in which there are substituents of the cyclopentadienyl groups bonded to both cyclopentadienyl groups. Particular preference is given to complexes whose substituted or unsubstituted cyclopentadienyl groups additionally have substitution on two adjacent carbon atoms by cyclic groups, where the cyclic groups may also have been integrated within a heteroaromatic system.

Other preferred metallocenes are those which contain only one substituted or unsubstituted cyclopentadienyl group which, however, has substitution by at least one radical also bonded to the central atom.

Examples of suitable metallocene compounds are ethylenebis(indenyl)zirconium dichloride, ethylenebis(tetrahydroindenyl)zirconium dichloride, diphenylmethylene-9-fluorenylcyclopentadienylzirconium dichloride, dimethylsilanediylbis(3-tert-butyl-5-methylcyclopentadienyl)-zirconium dichloride, dimethylsilanediyl(2-methyl-4-azapentalene)(2-methyl-4-(4'-methylphenyl)-indenyl)zirconium dichloride, dimethylsilanediyl(2-methyl-4-thiapentalene)(2-ethyl-4-(4'-tert-butylphenyl)indenyl) zirconium dichloride, ethanediyl(2-ethyl-4-azapentalene)(2-ethyl-4-(4'-tert-butylphenyl)indenyl)zirconium dichloride, dimethylsilanediylbis(2-methyl-4-azapentalene)zirconium dichloride, dimethylsilanediylbis(2-methyl-4-thiapentalene) zirconium dichloride, dimethylsilanediylbis(2-methylindenyl)zirconium dichloride, dimethylsilanediylbis(2-methylbenzindenyl)zirconium dichloride, dimethylsilanediylbis(2-methyl-4-phenylindenyl)zirconium dichloride, dimethylsilanediylbis(2-methyl-4-naphthylindenyl)zirconium dichloride, dimethylsilanediylbis(2-methyl-4-isopropylindenyl)zirconium dichloride and dimethylsilanediylbis (2-methyl-4,6-diisopropylindenyl) zirconium dichloride, and also the corresponding dimethylzirconium compounds.

The metallocene compounds are either known or can be obtained by known methods. It is also possible to use mixtures of metallocene compounds of this type for catalysis, or to use the metallocene complexes described in EP-A 416 815.

The metallocene catalyst systems also comprise metallocenium-ion-forming compounds. Those suitable are strong, neutral Lewis acids, ionic compounds with Lewis-acid cations or ionic compounds with Brönsted acids as cation. Examples of these are tris(pentafluorophenyl)borane, tetrakis(pentafluorophenyl)borate and salts of N,N-dimethylanilinium. Other suitable metallocenium-ion-forming compounds are open-chain or cyclic aluminoxane compounds. These are usually prepared by reacting trialkylaluminum compounds with water and are generally mixtures of linear and also cyclic chain molecules of various lengths.

The metallocene catalyst systems may moreover comprise organometallic compounds of the metals of the 1st, 2nd or 3rd main group of the Periodic Table, for example n-butyllithium, n-butyl-n-octylmagnesium or triisobutylaluminum, triethylaluminum or trimethylaluminum.

The polypropylenes used for the support layer are prepared by polymerization in at least one reaction zone, or else frequently in two or even more reaction zones arranged in series (a reactor cascade), in the gas phase, in suspension or in the liquid phase (bulk). The usual reactors for polymerizing $C_2$–$C_8$ 1-alkenes may be used. Examples of suitable reactors are continuous stirred-tank reactors, loop reactors and fluidized-bed reactors. The size of the reactors is not significant here. It depends on the output which is to be achieved in the individual reaction zone(s).

Use is in particular made of fluidized-bed reactors or else horizontally or vertically agitated powder-bed reactors. The reaction bed is generally composed of the polymer made from $C_2$–$C_8$-1-alkenes which is polymerized in the respective reactor.

The polypropylenes used as support layers are polymerized under conventional reaction conditions at from 40 to 120° C., in particular from 50 to 100° C., and at pressures of from 10 to 100 bar, in particular from 20 to 50 bar.

The polypropylenes used as supports generally have a melt flow rate (MFR), to ISO 1133, of from 0.1 to 200 g/10 min, in particular from 0.2 to 100 g/10 min, at 230° C. under a load of 2.16 kg.

It is also possible to use blends, i.e. mixtures of different thermoplastics, as support for the decorative part of the novel cover plate, for example blends made from a copolymer of styrene with acrylonitrile and a copolymer made from butadiene and acrylonitrile.

The decorative part preferably also comprises an intermediate layer between the support and the heat-cured layer, in particular a bonding layer made from a thermoplastic, preferably from the thermoplastic used to make the support, and this particularly improves the adhesion between support and intermediate-layer. The intermediate layer is in particular a thin film or a thin web of thickness from 0.001 to 1.0 mm, in particular from 0.005 to 0.3 mm. Possible materials for the intermediate layer are the thermoplastics described above for the supports, i.e. in particular polypropylene and polyethylene, polymers of styrene, polyoxymethylene or polybutylene terephthalate.

Other materials preferred as intermediate layer are resin-saturated webs and resin-saturated thermoplastic films. The resins used for this are in particular acrylate resins, phenolic resins, urea resins or melamine resins. The degree of resinification here may be up to 300%, meaning that practically the entire surface of the intermediate layer has more than one coating of resin. The degree of resinification is preferably from 50 to 150%, in particular from 80 to 120%. The weight of intermediate layer per $m^2$ is from 15 to 150 g, in particular from 30 to 60 g.

In a preferred embodiment the decorative part present in the novel cover plate may also have a decorative layer arranged on the intermediate layer between the intermediate layer and the heat-cured layer.

The decorative layer may be composed of a plastic which has an embossment or a coloration, or both combined, and this may be in the form of a ready-to-use laminate. However, the decorative layer may also be composed of paper or of a fabric or of a paper-like or fabric-like or wood-like or metal-like material. Examples of these materials would be decorative layers made from an aluminum-type material or from a stainless-steel-type material or else from a leather-, silk-, wood-, cork- or linoleum-type material. The decorative layer may also have been resinified with acrylic resins, phenolic resins, urea resins or melamine resins, with a degree of resinification of from 50 to 300%, in particular from 100 to 300%, based on the weight of the decorative layer. The weight of the decorative layer is usually from 10 to 200 g/$m^2$, in particular from 30 to 150 g/$m^2$ and particularly preferably from 50 to 130 g/$m^2$. The decorative layer may also be composed of a colored plastic.

The heat-cured layer (overlay) arranged on the decorative layer is preferably composed of a thermoset, for example of a paper saturated with acrylic resin, with phenolic resin, with melamine resin or with urea resin and crosslinked by exposure to pressure or heat during the production of the layered composite material. The weight of the heat-cured layer (overlay) is usually from 10 to 300 g/$m^2$, in particular from 15 to 150 g/$m^2$ and particularly preferably from 20 to 70 g/$m^2$.

The heat-cured layer (overlay) may also, if desired, have been arranged as a ready-to-use laminate on the intermediate layer, on one or else on both sides. It is also possible to apply to the intermediate layer a ready-to-use laminate which is composed of the decorative layer and of the overlay. Ready-to-use laminates of this type are known per se and are available, inter alia, from Melaplast in Schweinfurt, Germany.

The overall thickness of the decorative part, composed of the support, the intermediate layer, if used, the decorative layer and the heat-cured layer is from 0.5 to 10 mm, preferably from 1 to 3 mm, and at least 10%, preferably from 50 to 95%, of the overall thickness is made up by the support.

The decorative part may be produced by a process in which the materials for the decorative layer, the heat-cured layer and, if used, the intermediate layer, each in the form of thin sheets, are bonded with the support material at from 150 to 300° C., in particular from 160 to 280° C.

The decorative layer and the heat-cured layer (overlay), and also, if used, the intermediate layer, may also be used together in the form of a ready-to-use laminate which is likewise a sheet. The bonding of the individual layers to one another may also take place by customary plastics industry processes. Examples of these customary processes are injection molding, extrusion and hot press molding of the individual layers.

The novel cover plate further comprises a reinforcer with integrated, molded-on functional elements, where the reinforcer has the structure of a sheet or box or crate and has a closed lower side. The reinforcer may also have ribs.

Examples of integrated, molded-on functional elements which may be used are dispenser boxes, condensation boxes, apparatuses for an integrated means of conveying water, or retaining elements for valves, or elements to fasten the cover plate to the device (e.g. screw domes), or elements for fastening cables or tubing, and either the upper part of a functional element of this type, or else the entire element per se, may be integrated into the reinforcer. If the molded-on functional elements are integrated into the reinforcer, the household device manufacturer can save some or all of the costs for assembling the separately produced parts of a functional element.

The reinforcer is preferably composed of thermoplastics, and reference may be made to the description of the constituents of the support for the decorative part in relation to the individual types of thermoplastics. However, the reinforcer may also be composed of metals or of thermosets. It can moreover be advisable to manufacture the reinforcer from the thermoplastic used to manufacture the decorative part, for example polypropylene.

A reinforcer of this type with integrated and molded-on functional elements may be produced by producing a sheet-type, box- or crate-type or rib-type base which has a closed lower side directly with the functional elements (i.e. integrating these) or welding the base to the functional element (s), in which case the welding surface can be removed from the visible area for esthetic reasons, to obtain an uninterrupted periphery. The sheet-type, box- or crate-type or rib-type base may, however, also be connected to the integrated, molded-on functional element(s) by screwing or bolting, riveting or interlocking, or by way of elements for mechanical fastening, for example snap connectors. The dimensioning of the reinforcers, for example with regard to their wall thickness or rib geometry, may take place using FEM computer calculation methods based on the particular requirements which have to be met, since this can give a base design with the greatest possible saving in material.

The base of plate type, box or crate type or rib type, and also the integrated, molded functional elements, which together form the reinforcer, may be produced by customary processes, for example by injection molding, extrusion, or hot press molding.

The novel cover plate is produced by joining the decorative part to the reinforcer. A preferred production process here begins with a first step in which at least one integrated, molded-on functional element is secured to the reinforcer. In a second step the reinforcer is then bonded to the decorative part, for example by welding, screwing or bolting, riveting or interlocking, or by elements for mechanical fastening, for example clips or snap connectors.

The connection of the novel cover plate to the appropriate household device is usually made by way of molded-on elements for fastening, for example by screwing or bolting, by interlocking for by a combination of these, as appropriate to the requirements and technical equipment of the manufacturers of these household devices. The specific arrangement of the novel cover plate here makes it possible to mold appropriate elements for fastening, for example screw domes, clips or snap connectors, directly onto the reinforcer straightaway during its production. This allows an operation to be saved when the cover plate is mounted onto the household device. Other elements of household devices, for example clips for fastening cables or tubing, or else elements for suspending the vibratory system, can also be molded directly onto the novel cover plate.

The novel cover plate features, inter alia, high strength and stability, is moisture-, scratch- and chemicals-resistant, easy to produce and also recyclable, in particular if the thermoplastic used in the decorative part is that also used in the reinforcer. Since the reinforcer has been provided with integrated, molded functional elements it is moreover possible to dispense with some operations when mounting the novel cover plate onto the appropriate household device.

The novel cover plate is suitable for a variety of household device types, for example as a constituent of washing machines, household dryers or dishwashers, or of kitchen furniture. In the case of washing machines the novel cover plate may in particular be used as a cover plate for front-loaders or for top-loader washing machines, and in the case of household dryers in particular as a cover plate either for condensing dryers or for ventilated dryers.

The process, which is also novel, for producing the cover plate is simple to carry out and has the particular feature that it can be carried out using customary mounting methods.

The drawings below—FIGS. 1 and 2—give diagrams of some examples of embodiments of the novel cover plate, and these are described in more detail below.

DETAILED DESCRIPTION OF THE DRAWINGS

Figure 1A:
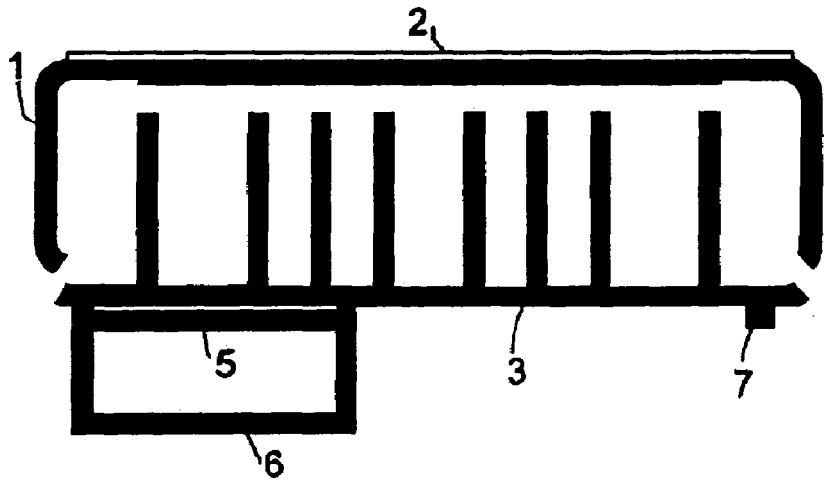
FIG. 1 shows a cover plate for a front-loader washing machine.
Figure 1B:
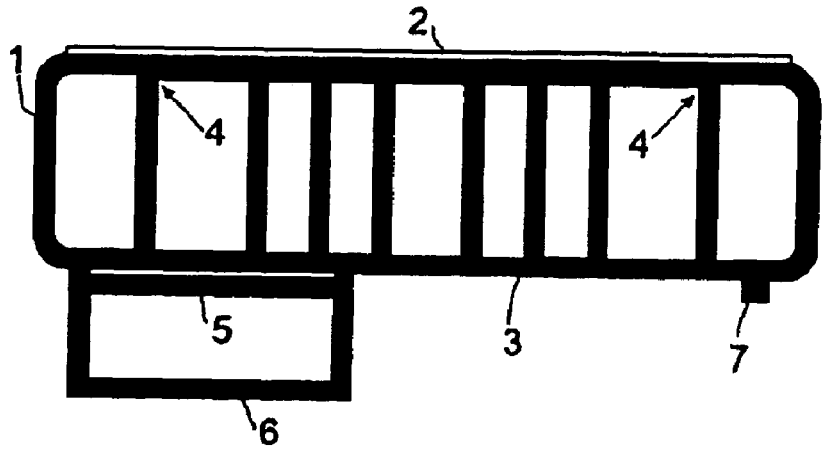

Description of FIG. 1:

FIG. 1*a* shows a cover plate for a front-loader washing machine, composed of a decorative part [support (1) and decorative layer (2)] and a reinforcer (3). In FIG. 1*b* the decorative part has been welded [weld surface (4)] by means of a heating element to the reinforcer (3) to give a box- or crate-type component.

The support (1) is composed of a propylene homopolymer (e.g. Hostacom® PPU 2090L, from Targor GmbH), and the reinforcer (3), the upper water duct section (5) and the dispenser tray cover (6) are composed of a talc-reinforced polypropylene (Hostacom® HC M4U42, from Targor GmbH).

Various functional elements, e.g. screw domes (7) and the lower water duct section, have by this stage been molded onto the reinforcer.

The steps for manufacturing the cover plate are then as follows:

1) manufacture of the individual parts (dispenser tray cover (6), upper water duct section (5), reinforcer (3) and decorative part [support (1) and decorative layer (2)]
2) molding the upper water duct section onto the reinforcer (with integrated lower water duct section)
3) molding the dispenser tray cover onto the reinforcer
4) welding the decorative part to the reinforcer. Step 4 may also take place previously as step 2.

Figure 2:
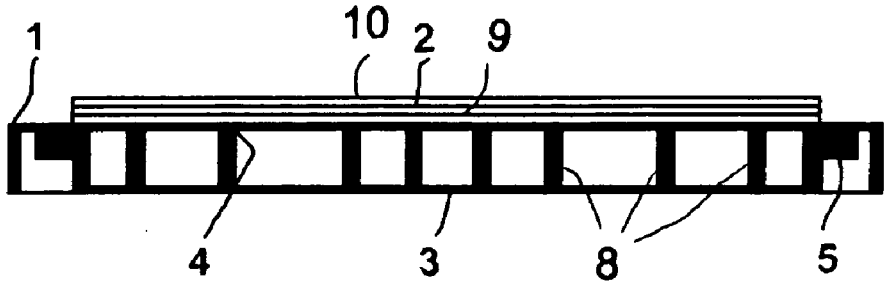
FIG. 2 shows a cover plate for a dishwasher.

Description of FIG. 2:

FIG. 2 shows a top plate for a dishwasher, composed of a decorative part [support (1), intermediate layer (9), heat-cured layer (10) and decorative layer (2)]. This has been welded [weld (4)] by means of a heating element to a reinforcer (3) to give a box- or crate-type component.

The support (1) is composed of a commercially available pigmented ABS plastic (terpolymer made from acrylonitrile, butadiene and styrene). The reinforcer (3) may be made from a polystyrene provided with a blowing agent (also impact-modified) or from a recycled material made from ABS plastics. Molded onto the reinforcer (3) by this stage are functional elements (5) for securing the sheet on the device. The functional elements (5) may be screw domes, inter alia.

The steps to manufacture the part are then as follows:

1) manufacture of the individual parts (reinforcer and decorative part)
2) welding of the decorative part to the reinforcer.

We claim:

1. A cover plate for household devices, comprising a decorative part and a reinforcer with integrated molded-on functional elements, where the reinforcer has the structure of a sheet or box or crate and has a closed lower side, and where the decorative part is composed of a support, of a decorative layer applied thereto, and of a heat-cured layer situated on the decorative layer and where the reinforcer is welded to the support of the decorative part.

2. A cover plate as claimed in claim 1, where the decorative part also has an intermediate layer between the support and the decorative layer.

3. A cover plate as claimed in claim 1, where the support is composed of a thermoplastic.

4. A cover plate as claimed in claim 1, where the reinforcer has the structure of a box or crate.

5. A cover plate as claimed in claim 1, where the reinforcer also has ribs.

6. A cover plate as claimed in claim 1, where the integrated, molded-on functional element comprises a dispenser box.

7. A cover plate as claimed in claim 1, where the integrated, molded-on functional element comprises a condensation box.

8. A covet plate as claimed in claim 1, where the integrated, molded-on functional element has an apparatus for an integrated water duct.

9. A cover plate as claimed in claim 1, where the reinforcer is composed of thermoplastic.

10. A cover plate as claimed in claim 3, where the reinforcer is composed of the same thermoplastic as the support.

11. A cover plate as claimed in claim 10, where the thermoplastic is polypropylene.

12. A cover plate as claimed in claim 1, where the reinforcer and the support collectively form a closed box- or crate-type component.

* * * * *